US006175104B1

(12) United States Patent
Greene et al.

(10) Patent No.: US 6,175,104 B1
(45) Date of Patent: Jan. 16, 2001

(54) MICROWAVE PROBE APPLICATOR FOR PHYSICAL AND CHEMICAL PROCESSES

(75) Inventors: Gary Roger Greene, Waxhaw, NC (US); Lois B. Jassie, Bethesda, MD (US); Edward Earl King; Michael J. Collins, both of Charlotte, NC (US)

(73) Assignee: CEM Corporation, Matthews, NC (US)

( * ) Notice: Under 35 U.S.C. 154(b), the term of this patent shall be extended for 0 days.

(21) Appl. No.: 09/148,080

(22) Filed: Sep. 4, 1998

(51) Int. Cl.[7] ..... H05B 6/64
(52) U.S. Cl. ..... 219/679; 219/697
(58) Field of Search ..... 219/679, 712, 219/713, 729, 736, 746, 748, 749, 762, 697, 730, 710, 695; 422/21, 299; 343/895

(56) References Cited

U.S. PATENT DOCUMENTS

| | | | | |
|---|---|---|---|---|
| 3,941,967 | * | 3/1976 | Sumi et al. | 219/729 |
| 4,190,757 | * | 2/1980 | Turpin et al. | 219/730 |
| 4,292,960 | | 10/1981 | Paglione . | |
| 4,398,077 | * | 8/1983 | Freedman et al. | 219/729 |
| 4,501,946 | * | 2/1985 | Nibbe et al. | 219/729 |
| 4,612,940 | * | 9/1986 | Kasevich et al. | 607/154 |
| 4,632,127 | * | 12/1986 | Sterzer | 607/156 |
| 4,743,725 | * | 5/1988 | Risman | 219/691 |
| 4,778,970 | * | 10/1988 | Klaila | 219/697 |
| 4,841,988 | * | 6/1989 | Fetter et al. | 607/154 |
| 5,039,495 | * | 8/1991 | Kutner et al. | 422/299 |
| 5,049,816 | * | 9/1991 | Moslehi | 324/767 |
| 5,073,167 | | 12/1991 | Carr et al. . | |
| 5,308,944 | | 5/1994 | Stone-Elander et al. . | |
| 5,369,251 | | 11/1994 | King et al. . | |
| 5,444,452 | * | 8/1995 | Ito et al. | 343/700 MS |
| 5,534,070 | * | 7/1996 | Okamura et al. | 118/723 E |
| 5,599,294 | | 2/1997 | Edwards et al. . | |
| 5,599,295 | | 2/1997 | Rosen et al. . | |
| 5,620,480 | * | 4/1997 | Rudie | 607/101 |
| 5,645,748 | * | 7/1997 | Schiffmann et al. | 219/710 |
| 5,659,874 | | 8/1997 | Rault et al. . | |
| 5,872,549 | * | 2/1999 | Huynh et al. | 343/895 |

FOREIGN PATENT DOCUMENTS 2500707 8/1982 (FR) .

OTHER PUBLICATIONS

S. Shetty et al., "Microwave Applicator Design for Cardiac Tissue Ablations, " Journal of Microwave Power and Elecromagnetic Energy, vol. 31, No. 1, 1996, pp. 59–66.

Henryk Matusiewicz, "Development of a High Pressure/Temperature Focused Microwave Heated Teflon Bomb for Sample Preparation," Anal. Chem., vol. 66, No. 5, Mar. 1, 1994, pp. 751–755.

* cited by examiner

*Primary Examiner*—Teresa Walberg
*Assistant Examiner*—Quang Van
(74) *Attorney, Agent, or Firm*—Philip Summa, P.A.

(57) ABSTRACT

A microwave heating system is disclosed for enhancing physical and chemical processes. The system includes a microwave source, an antenna having a cable, a receiver for receiving microwaves generated by the source, with the receiver being connected to a first end of the cable, and a transmitter for transmitting microwaves generated by the source, and with the transmitter being connected to an opposite end of the cable. The system also includes a reaction vessel with the transmitter inside the reaction vessel; and a microwave shield surrounding the transmitter for preventing microwaves emitted from the transmitter from extending substantially beyond the reaction vessel.

41 Claims, 7 Drawing Sheets

MICROWAVE PROBE APPLICATOR FOR PHYSICAL AND CHEMICAL PROCESSES

FIELD OF THE INVENTION

The invention relates to microwave enhancement of physical and chemical reactions. In particular, the invention relates to a microwave heating device and associated technique that can be used independent of a conventional microwave cavity and remotely from a microwave source.

BACKGROUND OF THE INVENTION

In chemical synthesis and related processes, conventional heating devices typically use conduction (e.g., hot plates) or convection (e.g., ovens) to heat reaction vessels, reagents, solvents, and the like. Under some circumstances, these kinds of devices can be slow and inefficient. Moreover, maintaining the reactants at a temperature set point can be difficult using conduction or convection methods, and quick temperature changes arc almost impossible.

Conversely, the use of microwaves, which heat many materials (including many reagents) directly, can speed some processes (including chemical reactions) several orders of magnitude. This not only reduces reaction time, but also results in less product degradation—a result of the interactive nature of microwave heating. In some cases, reactions facilitated by microwave devices proceed at a lower temperature, leading to cleaner chemistry and less arduous work-up of the final product. In addition, microwave energy is selective—it couples readily with polar molecules—thereby transferring heat instantaneously. This allows for controllable field conditions producing high-energy density that can then be modulated according to the needs of the reaction.

Many conventional microwave devices, however, have certain limitations. For example, microwave devices are typically designed to include a rigid cavity. This facilitates the containment of stray radiation, but limits the usable reaction vessels to sizes and shapes that can fit inside a given cavity, and requires that the vessels be formed of microwave transparent materials. Moreover, heating efficiency within such cavities tends to be higher for larger loads and less efficient for smaller loads. Heating smaller quantities within such devices is less than ideal. Measuring temperatures within these cavities is complicated. Another problem associated with microwave cavities is the need for cavity doors (and often windows) so that reactions vessels can be placed in the cavities and thc reaction progress reaction may be monitored. This introduces safety concerns, and thus necessitates specially designed seals to prevent stray microwave radiation from exiting the cavity.

Alternatively, typical microwave cavities are rarely designed ordinary laboratory glassware. Thus, either such cavities or the glassware must be modified before it can be used in typical devices. Both types of modifications can be inconvenient, time-consuming, and expensive.

Furthermore, the typical microwave cavity makes adding or removing components or reagents quite difficult. Stated differently, conventional microwave cavity devices tend to be more convenient for reactions in which the components can simply be added to a vessel and heated. For more complex reactions in which components must be added and removed as the reaction (or reactions) proceed, cavity systems must be combined with rather complex arrangements of tubes and valves. In other cases, a cavity simply cannot accommodate the equipment required to carry out certain reactions.

Some microwave devices use a waveguide fitted with an antenna (or "probe") to deliver radiation in the absence of a conventional cavity. Such devices essentially transmit microwave energy to the outside of a container to facilitate the reaction of reactants contained therein, e.g., Matusiewicz, *Development of a High Pressure/Temperature Focused Microwave Heated Teflon Bomb for Sample Preparation,* Anal. Chem. 1994, 66, 751–755. Nevertheless, the microwave energy delivered in this manner typically fails to penetrate far into the solution. In addition, probes that emit radiation outside of an enclosed cavity generally require some form of radiation shielding. Thus, such probe embodiments have limited practical use and tend to be employed mainly in the medical field. In this context, however, the applied power is typically relatively lower, i.e., medical devices tend to use low power (occasionally 100 watts, but usually much less and typically only a few) at a frequency of 915 megahertz, which has a preferred penetration depth in human tissue. Moreover, because microwave medical probes are typically employed inside a body, stray radiation is absorbed by the body tissues, making additional shielding unnecessary.

OBJECT AND SUMMARY OF THE INVENTION

Therefore, it is an object of the invention to provide a new microwave device to facilitate heating steps in physical and chemical processes that avoids the limitations imposed by cavities.

In a primary aspect, the invention comprises a microwave source, an antenna, a reaction vessel, and a shield for containing the microwaves generated at the antenna from reaching or affecting the surroundings other than the desired chemical reaction. In most embodiments, the shield takes the form of metal mesh in a custom shape. When placed adjacent to the antenna, the mesh forms a porous cell that prevents microwaves from traveling beyond the intended reaction area, while still irradiating the desired reagents. When placed around a reaction vessel, the mesh permits the reagents to remain visible, should such observation be desired or necessary.

In another aspect, the source end of the probe can also comprise a microwave-receiving antenna. Using this embodiment, the invention can be "plugged into" conventional devices to receive and then retransmit the microwaves to the desired location or reactions.

In yet another aspect, the invention can also incorporate a temperature sensor with the probe. Detectors employing fiber optic technology are especially useful because they are largely unaffected by electromagnetic fields. Measured temperatures can then be used to control applied power or other variables.

In another aspect, the invention is a method of carrying out microwave-assisted chemical reactions.

The foregoing, as well as other objectives and advantages of the invention and the manner in which the same are accomplished, are further specified within the following detailed description and its accompanying drawings, which:

DETAILED DESCRIPTION

Figure 1:
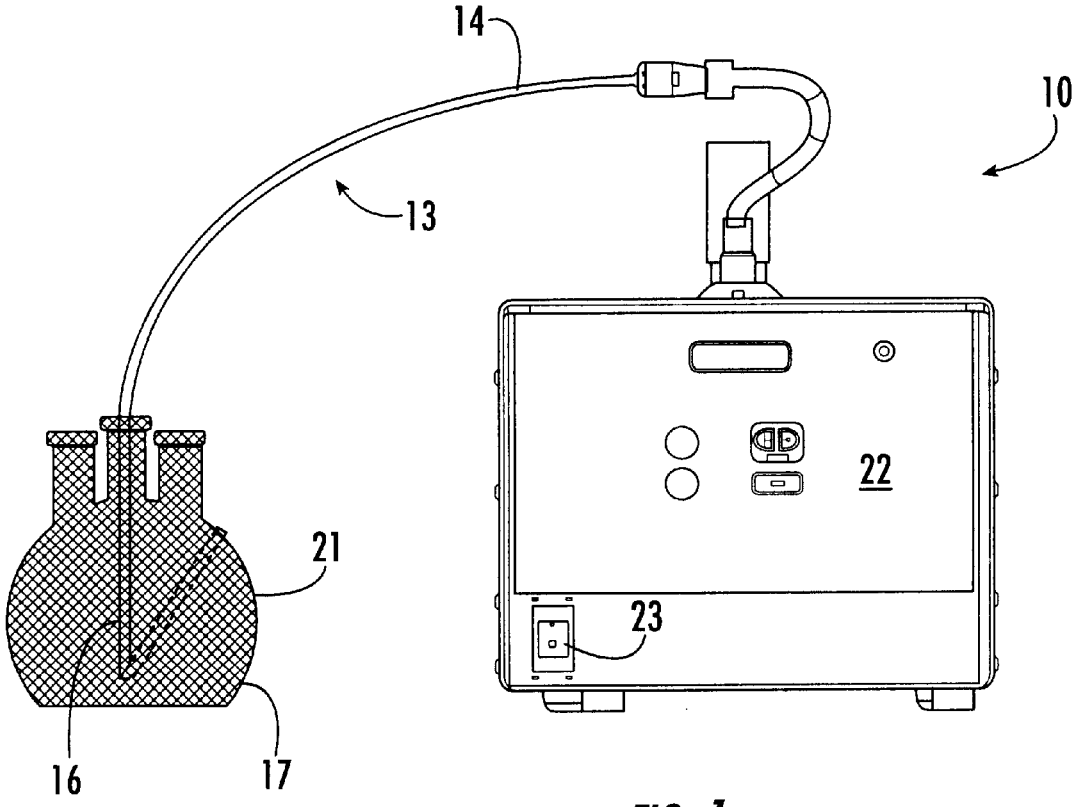
FIG. 1 is a front perspective view of the first embodiment of the apparatus according to the present invention.

The present invention is a microwave system for enhancing chemical reactions. FIGS. 1, 4, and 7 illustrate the device in more general fashion while FIGS. 2, 3, 5, 6, and 8 show additional details. It will be understood at the outset that although much of the description herein refers to chemical reactions, the basic advantages of the invention also apply fundamentally to heating processes in general, including simple heating of solvents and solutions.

FIG. 1 is an overall perspective view of the device that is broadly illustrated at 10 in FIG. 1. The device comprises a microwave source which in the drawings is illustrated as the magnetron 11 (e.g., FIGS. 4 and 5), but which also can be selected from the group consisting of magnetrons, klystrons, switching power supplies, and solid-state sources. The nature and operation of magnetrons, klystrons, and solid-state sources is generally well understood in the art and will not be repeated in detail herein. The use of a switching power supply to generate microwave radiation is set forth in more detail in co-pending and commonly assigned U.S. patent application Ser. No. 09/063,545, filed Apr. 21, 1998, for "Use of Continuously Variable Power in Microwave Assisted Chemistry," the contents of which are incorporated entirely herein by reference. In the illustrated embodiments, the magnetron 11 is driven by such a switching power supply and propagates microwave radiation into a waveguide 12 (FIGS. 6 and 7) that is in communication with the magnetron 11.

The invention further comprises an antenna broadly designated at 13 in FIG. 1. The antenna includes a cable 14, a receiver 15 (FIG. 7) for receiving microwaves generated by the magnetron 11, and which is connected to a first end of the cable 14. The antenna further comprises a transmitter 16 at the opposite end of the cable 14 for transmitting microwaves generated by the magnetron 11. The cable 14 is most preferably a coaxial cable and the transmitter 16 is an exposed portion of the center wire and that is about one-quarter wavelength long. Other desirable and general aspects of antennas are well known in the art, and can be selected without undue experimentation, e.g., Dorf, infra at Chapter 38.

As illustrated in FIG. 1, the system of the present invention includes a reaction vessel 17 with the transmitter 16 of the antenna 13 inside the reaction vessel 17.

Figure 2:
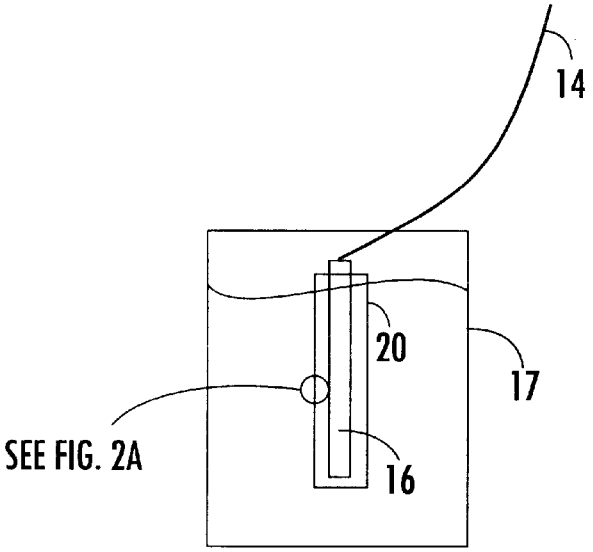
FIGS. 2 and 3 are cross-sectional schematic diagrams of the use of a microwave shield in conjunction with the present invention.
Figure 2A:
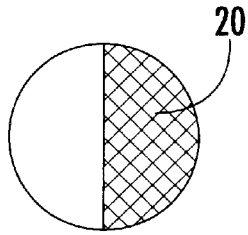
Figure 3:
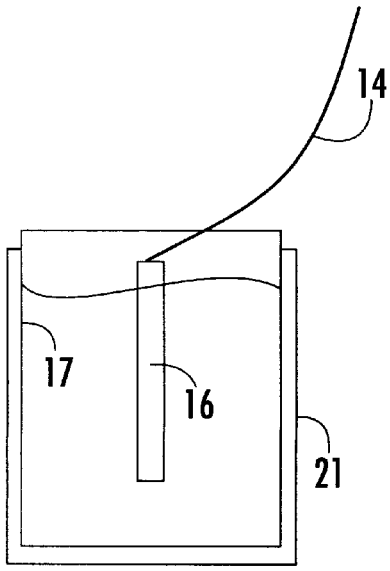
Figure 4:
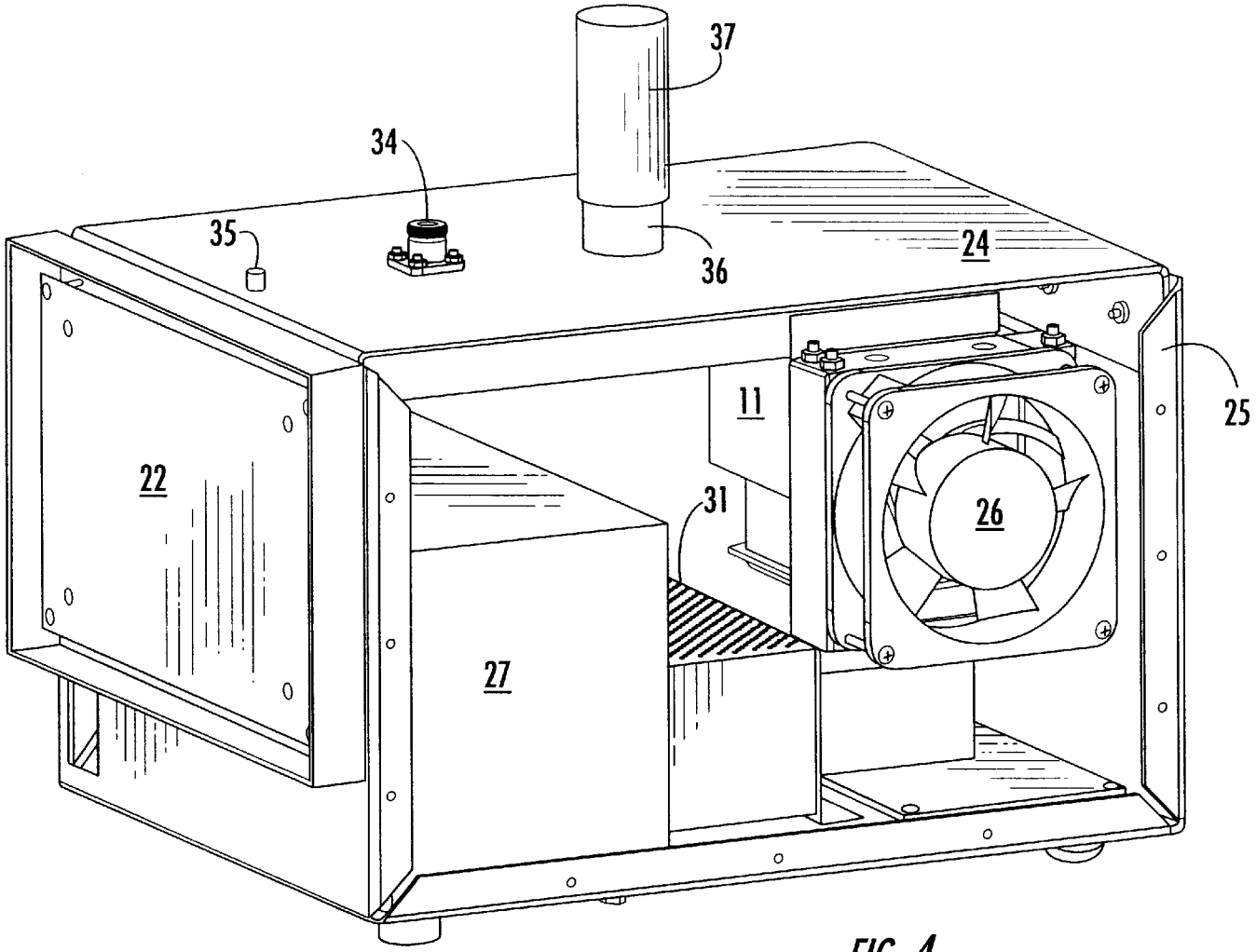
FIG. 4 is another perspective view of an apparatus according to the present invention.

FIGS. 2 and 3 are schematic diagrams of the cable 14, the transmitter 16, and the reaction vessel 17, and illustrate that the invention further comprises a microwave shield shown at 20 in FIG. 2 and 21 in FIGS. 1 and 3 for preventing microwaves emitted from the transmitter 16 from extending substantially beyond the reaction vessel. FIGS. 2 and 3 illustrate the two most preferred embodiments of the invention, in which the shield 20 is placed inside the reaction vessel (FIG. 2), or with the shield in the form of a receptor jacket 21 that contiguously surrounds the reaction vessel (FIG. 3). In both the embodiments of FIGS. 2 and 3, the shield 20 or 21 preferably comprises a metal mesh with openings small enough to prevent microwave leakage therethrough. For example, the openings may be less than about ¼ the wavelength of the microwave radiation. The relative dimensions of an appropriate mesh can be selected by those of ordinary skill in this art, and without undue experimentation. The metal mesh is particularly preferred for its porosity to liquids and gases which allows them to flow through the shield while they are being treated with microwave radiation from the antenna 16, and measurements to date indicate that microwave leakage is less than five (5) milliwatts per square centimeter ($mW/cm^2$) at a distance of six (6) inches with the transmitter immersed in a non-microwave absorbing solvent at maximum forward power. Flexible wire and mesh cloths of between 0.003" and 0.007" are quite suitable for microwave frequencies. Aluminum and copper are most preferred for the metal mesh, but any other metals are also acceptable provided that they are sufficiently malleable to be fabricated to the desired or necessary shapes and sizes. The shield can, however, be formed of any appropriate material (e.g., metal foil or certain susceptor materials) and in any particular geometry that blocks the microwaves while otherwise avoiding interfering with the operation of the antenna, the chemical reaction, or the vessel. Where desired or appropriate, several layers of mesh can be used to increase the barrier density.

It will thus be understood that the invention, particularly the embodiment of FIG. 2, provides a great deal of flexibility in carrying out microwave assisted chemical reactions. In particular, the antenna 16 and shield 20 can be placed in a wide variety of conventional vessels, and can be used to microwave enhance the reactions in those vessels, while at the same time preventing the escape of microwave radiation beyond the shield. Thus, the need for a conventional cavity can be eliminated.

Similarly, in the embodiment illustrated in FIG. 3, the contiguous shield 21 can be manufactured in a number of standard vessel sizes and shapes making it quite convenient in its own right for carrying out microwave assisted chemistry in the absence of a cavity, and at positions remote from the microwave source. In yet other embodiments, the microwave shield, and particularly a metal mesh, can be incorporated directly within the vessel itself in a customized fashion somewhat analogous to the manner in which certain structural glass is reinforced with wire inside.

It will be further understood that the antenna can include a plurality of transmitters, so that a number of samples can be heated by a single device. This provides the invention with particular advantages for biological and medial applications; e.g., a plurality of transmitters used in conjunction with a plurality of samples, such as the typical 96-well titer plate.

In preferred embodiments, the microwave system of the invention further comprises means for measuring temperature within the reaction vessel 17. Although metal-based devices such as thermocouples can be successfully incorporated into microwave systems, the fiber-optic devices tend to be slightly more preferred because they avoid interfering with the electromagnetic field, and vice versa. Preferred sensors can quickly measure temperatures over a range from −50° to 250° C. In the most preferred embodiments, the temperature measuring means acts in conjunction with a controller that moderates the microwave power supply or source as a function of measured temperature within the reaction vessel. Such a controller is most preferably an appropriate microprocessor. The operation of feedback controllers and microwave processors is generally well understood in the appropriate electronic arts, and will not be otherwise described herein in detail. Exemplary discussions are, however, set forth, for example, in Dorf, *The Electrical Engineering Handbook,* 2d Edition (1997) by CRC Press, for example, at Chapters 79–85 and 100.

It will be further understood that the combination of temperature measurement, feedback, controller, and variable power supply greatly enhances the automation possibilities for the device.

In preferred embodiments, the temperature sensor is carried immediately adjacent the transmitter 16 and is thus positioned within the reaction vessel 17 with the transmitter 16. In embodiments where the temperature sensor is an optical device, it produces an optical signal that can be carried along a fiber optic cable that is preferably incorporated along with the cable 14 of the antenna 13. The same arrangement is preferred when the temperature sensor is one that produces an electrical signal (e.g., a thermocouple) and the appropriate transmitting means is a wire.

Figure 5:
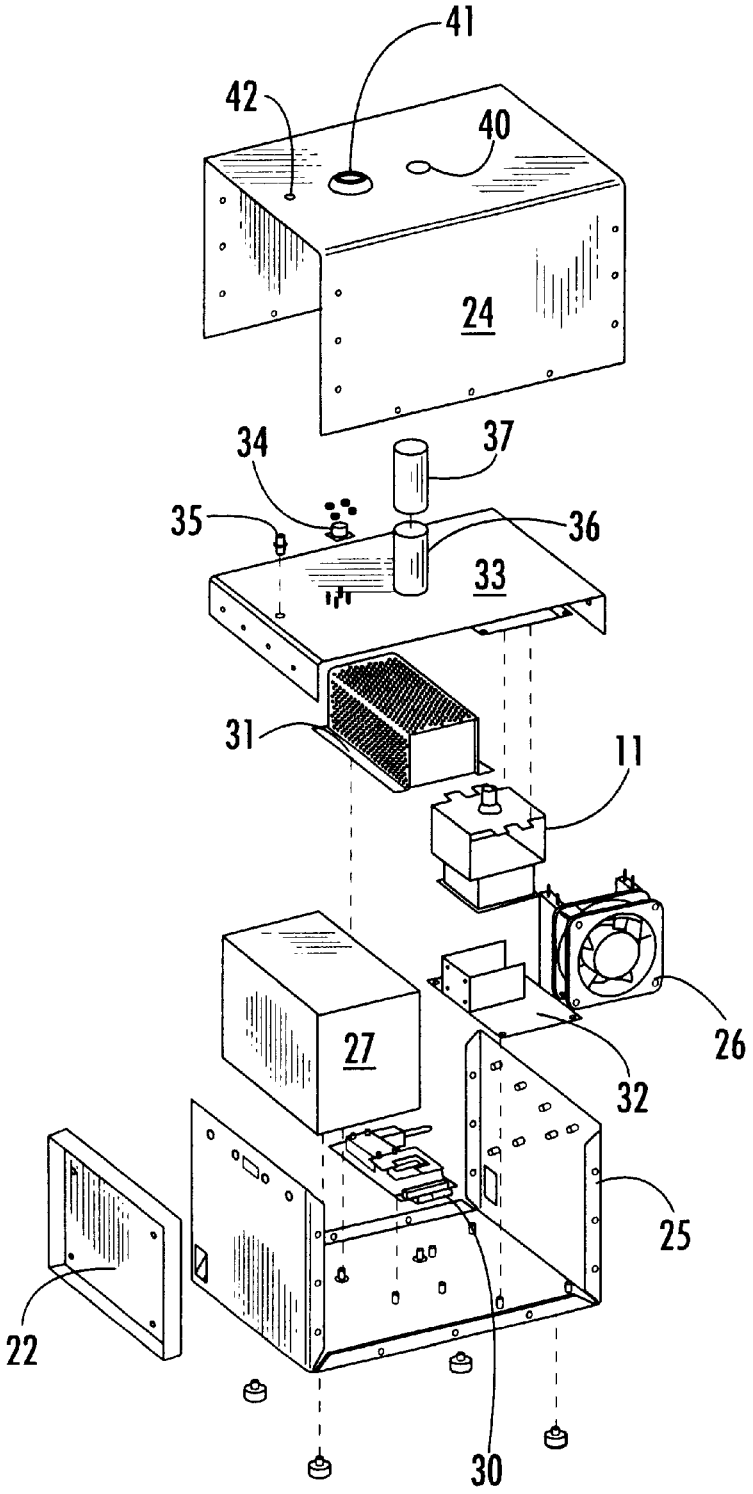
FIG. 5 is an exploded perspective view of the apparatus illustrated in FIG. 4.

The drawings illustrate additional aspects of the invention in more detail. FIG. 1, for example, illustrates a control panel 22 and a power switch 23 for the device 10. FIG. 5 shows perhaps the greatest amount of detail of the invention. As illustrated therein, the apparatus includes a housing formed of an upper portion 24 and a lower portion 25. The control panel 22 is fixed to the housing 25. The device further includes the magnetron 11, a cooling fan 26, and the solid-state or switching microwave power supply 27. An electronic control board for carrying out the functions described earlier is illustrated at 30 and includes an appropriate shield cover 31. A direct current (DC) power supply 32 supplies power for the control board 30 as necessary. In presently preferred embodiments, the switching power supply 27 and magnetron 11 can supply coherent microwave energy at 2450 MHz over a power range of −1300 watts. In order to avoid excess and unnecessary radiation, however, the power supply 27 is usually used at no more than about 700 watts.

In this regard, solid state sources are quite useful for lower-power applications, such as those typical of work in the life-sciences area, where power levels of 10 watts or less are still quite useful, especially in heating small samples. Solid state devices also provide the ability to vary both power and frequency. Indeed, a solid state source can launch microwaves directly to an antenna, thus eliminating both the magnetron and the waveguide. Thus, a solid state source permits the user to select and use fixed frequencies, or to scan frequencies, or to scan and then focus upon fixed frequencies based on the feedback from the materials being heated.

A waveguide cover 33 is also illustrated and includes sockets 34 for the receiver portion of the antenna and 35 for the fiber optic temperature device. FIG. 5 also illustrates a primary choke 36 and secondary choke 37, the use of which will be described with respect to FIGS. 6, 7, and 8. FIG. 5 illustrates that the upper housing 24 has respective openings 40, 41, and 42 for the chokes, the antenna socket, and the fiber optic socket.

FIG. 4 shows a number of the same details as FIG. 5, in an assembled fashion, including the control panel 22, the housing portions 24 and 25, the power supply 27, the magnetron 11, the fan 26, the switching power supply 27, the cover 31, the primary and secondary chokes 36 and 37, and the sockets 34 and 35.

Figure 6:
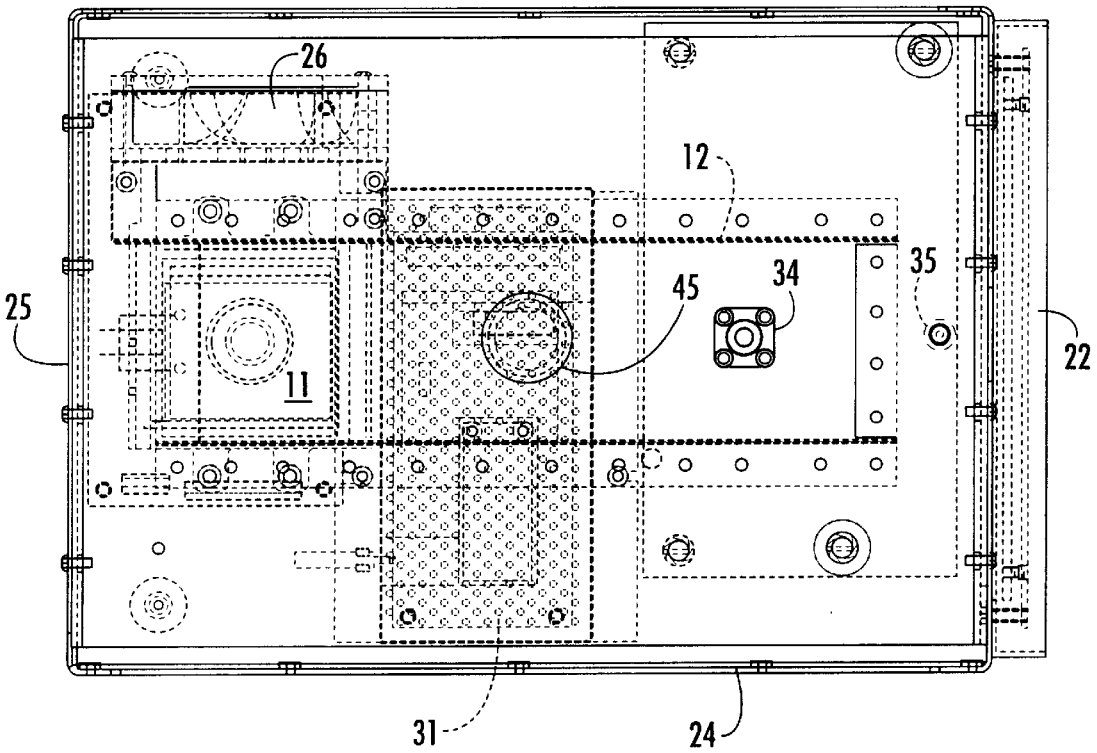
FIG. 6 is a top plan view of the apparatus illustrating certain interior portions.
Figure 7:
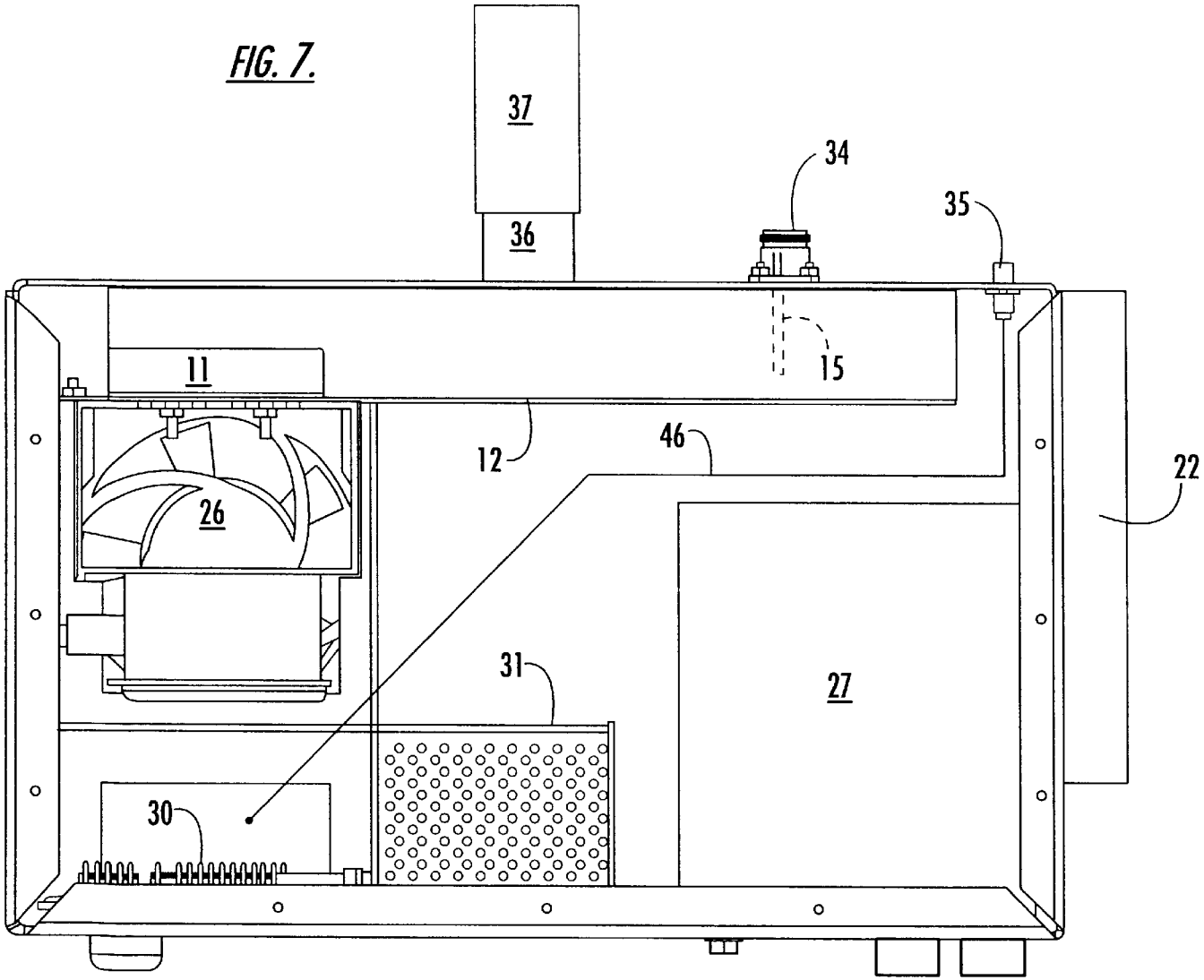
FIG. 7 is a side elevational view of the apparatus taken opposite to the side illustrated in FIG. 4.
Figure 8:
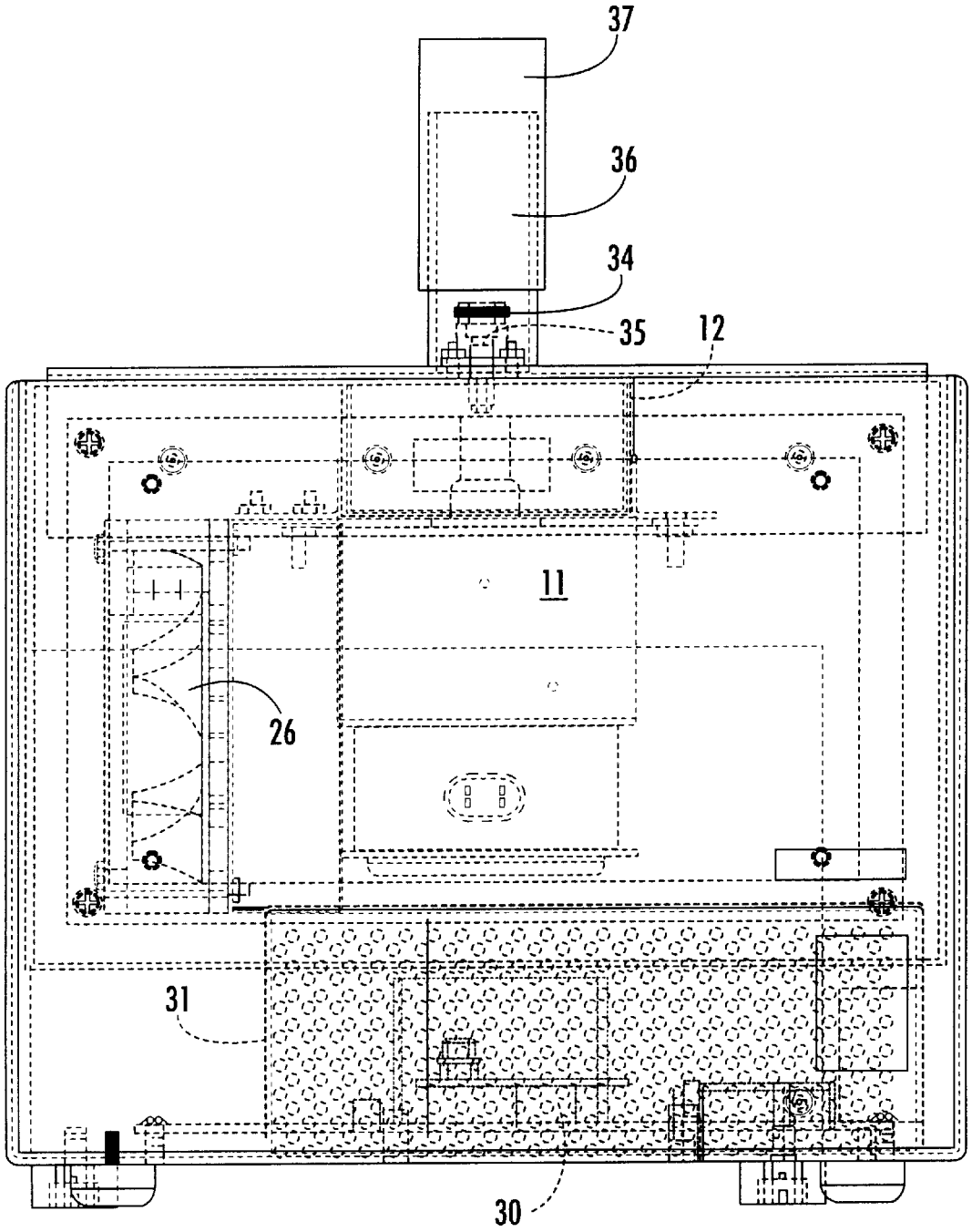
FIG. 8 is a rear elevational view of the apparatus according to the invention and likewise showing some of the interior components.

FIG. 6 illustrates that the primary and secondary chokes 36 and 37 form a supplemental sample holder designated at 45 in FIG. 6 that is adjacent to the waveguide 12 for positioning a reaction vessel in the waveguide 12 such that the contents of such a reaction vessel are exposed to microwaves independent of the antenna, the position of which is indicated in FIG. 6 by the socket 34. Thus, in another aspect, the invention comprises the microwave source 11 and the waveguide 12 connected to the source with the waveguide 12 including a sample holder 45 for positioning a reaction vessel in the waveguide 12 such that the contents of the reaction vessel are exposed to microwaves, along with the socket 34 for positioning an antenna receiver within the waveguide 12. The supplemental sample holder 45 provides an extra degree of flexibility and usefulness to the present invention in that, if desired, single samples can be treated with microwave radiation at the apparatus rather than remote from it.

In preferred embodiments, the sample holder 45 and the socket 34 are arranged along the waveguide 12 in a manner that positions the sample holder 45 between the source 11 and the socket 34. In this manner, the antenna receiver (15 in FIG. 7) does not interfere with the propagation of microwaves between the source 11 and a sample in the sample holder 45. Although the positions could be arranged differently, a receiver in the waveguide could have a tendency to change the propagation mode within the waveguide in a manner that might interfere with the desired or necessary interaction of the microwaves with a sample in the sample holder 45.

FIG. 7 also helps illustrate the arrangement among the waveguide 12, the magnetron 11, the chokes 36 and 37 that form the sample holder, and antenna 15, and the antenna socket 34. FIG. 7 also illustrates the control panel 22, the switching power supply 27, the board cover 31, and the control board 30. FIG. 7 also schematically illustrates the appropriate physical and electronic connection 46 between the fiber optic socket 35 and the control board 30 which, as noted above, allows the application of microwave power to be moderated in response to the measured temperature.

In another aspect, the invention comprises a method for enhancing chemical reactions comprising directing microwave radiation from a microwave source to a reaction vessel without otherwise launching microwave radiation, and then discharging the microwave radiation in a manner that limits the discharge to the reaction vessel while preventing microwave radiation from discharging to the surroundings substantially beyond the surface of the reaction vessel. It will be understood that for all practical purposes an appropriate shield will entirely prevent wave propagation, but that minor or insubstantial transmission falls within the boundaries of the invention.

As discussed with respect to the apparatus aspects of the invention, the step of directing the microwave radiation to a reaction vessel preferably comprises transmitting the radiation along an antenna which most preferably comprises a wire cable with an antenna receiver in a waveguide, and an antenna transmitter in the reaction vessel. As in the apparatus aspects of the invention, the step of discharging microwave radiation preferably comprises shielding the discharged microwave radiation within the reaction vessel or shielding the outer surface of the reaction vessel. In its method aspects, the invention further comprises the step of generating the microwave radiation prior to directing it from a microwave source to a reaction vessel, measuring the temperature within the reaction vessel, and thereafter controlling and moderating the microwave power and radiation as a function of the measured temperature.

In the drawings and specification, there have been disclosed typical embodiments of the invention, and, although specific terms have been used, they have been used in a generic and descriptive sense only and not for purposes of limitation, the scope of the invention being set forth in the following claims.

That which is claimed is:

1. A microwave heating system suitable for enhancing physical and chemical processes, said system comprising:

a microwave source;

an antenna in microwave communication with said source, said antenna having a microwave-transmitting cable, a receiver connected to a first end of said cable for receiving microwaves generated by said source, and a transmitter connected to an opposite end of said cable for transmitting microwaves generated by said source and carried by said cable;

a reaction vessel with said transmitter portion of said antenna inside said reaction vessel; and a microwave shield surrounding said transmitter for preventing microwaves generated by said source and emitted from said transmitter from extending substantially beyond said reaction vessel.

2. A microwave system according to claim 1 wherein said shield comprises a receptor jacket contiguously surrounding said reaction vessel.

3. A microwave system according to claim 2 wherein said receptor jacket comprises a metal mesh.

4. A microwave system according to claim 3 wherein said metal mesh comprises openings less than about ¼ the wavelength of the microwaves generated by said source.

5. A device according to claim 2 wherein said receptor jacket comprises a metal foil.

6. A microwave system according to claim 1 wherein said shield is inside said reaction vessel.

7. A microwave system according to claim 6 wherein said shield is porous to liquids and gases.

8. A microwave system according to claim 7 wherein said porous shield comprises a metal mesh.

9. A microwave system according to claim 8 wherein said metal mesh comprises openings less than about ¼ the wavelength of the microwaves generated by said source.

10. A microwave system according to claim 1 wherein said shield is incorporated into the structure of said reaction vessel.

11. A microwave system according to claim 10 wherein said shield is comprised of a metal mesh having openings less than about ¼ the wavelength of the microwaves generated by said source.

12. A microwave system according to claim 1 further comprising means for measuring temperature within the reaction vessel.

13. A microwave system according to claim 12 wherein the means for measuring temperature within the reaction vessel comprises a fiber optic device.

14. A microwave system according to claim 12 further comprising a controller that controls said source as a function of measured temperature within the reaction vessel.

15. A microwave system according to claim 14 wherein said controller comprises a computer processing unit.

16. A microwave system according to claim 1 further comprising a waveguide in communication with said source.

17. A microwave system according to claim 1 wherein said source is selected from the group consisting of magnetrons, klystrons, switching power supplies, and solid state sources.

18. A microwave system according to claim 1 comprising a plurality of transmitters on said antenna.

19. A microwave system for enhancing chemical reactions, comprising:

a microwave source;

a waveguide connected to said source;

an antenna in microwave communication with said source, said antenna having a microwave-transmitting cable, a receiver connected to a first end of said cable for receiving microwaves generated by said source, and a transmitter connected to an opposite end of said cable for transmitting microwaves generated by said source and carried by said cable;

a temperature sensor adjacent said transmitter; and a reaction vessel with said transmitter portion of said antenna and said temperature sensor therein.

20. A microwave system according to claim 19, further comprising:

a controller to control said source as a function of measured temperature within the reaction vessel; and means for transmitting temperature measurements from said sensor to said controller.

21. A microwave system according to claim 20 wherein said temperature sensor comprises an optical detector and said temperature measurement transmitting means comprises a fiber optic.

22. A microwave system according to claim 20 wherein said temperature sensor produces an electrical signal and said temperature measurement transmitting means is a wire.

23. A microwave system according to claim 20 wherein said temperature measurement transmitting means and said antenna are incorporated into a coaxial cable.

24. A microwave system according to claim 19 wherein said microwave source is selected from the group consisting of magnetrons, klystrons, switching power supplies, and solid state sources.

25. A microwave system according to claim 19 further comprising a supplemental sample holder adjacent to said waveguide for positioning a second reaction vessel in said waveguide such that the contents of said second reaction vessel are exposed to microwaves independent of said antenna.

26. A microwave system according to claim 25 wherein said sample holder comprises a microwave choke.

27. A microwave system according to claim 19 comprising a plurality of transmitters on said antenna.

28. A microwave system for enhancing chemical reactions, comprising:

a microwave source;

a waveguide connected to said source, a sample holder on said waveguide for positioning a reaction vessel in said waveguide such that the contents of the reaction vessel are exposed to microwaves; and a socket for positioning an antenna receiver within said waveguide.

29. A microwave system according to claim 28 wherein said sample holder and said socket are arranged along said waveguide such that said sample holder is positioned between said source and said socket.

30. A microwave system according to claim 28 further comprising an antenna having a cable, a receiver for receiving microwaves generated by said source, said receiver connected to said socket and a first end of said cable, and a transmitter for transmitting microwaves generated by said source, said transmitter connected to an opposite end of said cable.

31. A microwave system for enhancing chemical reactions, comprising:

a microwave source;

a waveguide in communication with said source;

a wire antenna in microwave communication with said source, said antenna having a receiver in said waveguide for receiving microwaves generated by said source and a microwave-transmitting cable, said receiver connected to a first end of said cable, and a transmitter connected to an opposite end of said cable for transmitting microwaves generated by said source and carried by said cable;

a reaction vessel with said transmitter portion of said antenna inside said reaction vessel; and a shield for containing the microwaves generated by said source and emitted from said transmitter and for preventing microwaves emitted from said transmitter from extending substantially beyond said reaction vessel.

32. A microwave system according to claim 31 further comprising a temperature sensor adjacent said transmitter.

33. A microwave system according to claim 32, further comprising:

a controller for moderating microwaves based upon the temperature detected; and means for transmitting temperature information from said temperature sensor to said controller.

34. A microwave system according to claim 33 wherein said temperature sensor is an optical detector and said transmitting means is a fiber optic.

35. A microwave system according to claim 33 wherein said temperature sensor produces an electrical signal and said transmitting means is a wire.

36. A microwave system according to claim 33 wherein said temperature information transmitting means and said wire antenna are incorporated into a coaxial cable.

37. A microwave system according to claim 31 wherein said microwave source is selected from the group consisting of magnetrons, klystrons, witching power supplies, and solid state sources.

38. A microwave system according to claim 31 further comprising a supplemental sample holder adjacent to said waveguide for positioning a second reaction vessel in said waveguide such that the contents of said second reaction vessel are exposed to microwaves independent of said wire antenna.

39. A microwave system according to claim 38 wherein said source, said sample holder, and said wire antenna receiver are arranged along said waveguide such that said sample holder is positioned between said source and said receiver.

40. A method according to claim 38 further comprising concurrently varying the microwave power.

41. A microwave system according to claim 31 comprising a plurality of transmitters on said antenna.

* * * * *